US005447201A

United States Patent [19]

Mohn

[11] Patent Number: 5,447,201

[45] Date of Patent: Sep. 5, 1995

[54] WELL COMPLETION SYSTEM

[75] Inventor: Frank Mohn, London, England

[73] Assignee: Framo Developments (UK) Limited, London, England

[21] Appl. No.: 64,075

[22] PCT Filed: Nov. 15, 1991

[86] PCT No.: PCT/GB91/02020

§ 371 Date: Aug. 20, 1993

§ 102(e) Date: Aug. 20, 1993

[87] PCT Pub. No.: WO92/08875

PCT Pub. Date: May 29, 1992

[30] Foreign Application Priority Data

Nov. 20, 1990 [GB] United Kingdom ..... 9025230

[51] Int. Cl.[6] ..... E21B 34/10

[52] U.S. Cl. ..... 166/375; 166/65.1; 166/67

[58] Field of Search ..... 166/53, 65.1, 67, 250, 166/321, 373–375

[56] References Cited

U.S. PATENT DOCUMENTS

| | | | |
|---|---|---|---|
| 2,822,757 | 2/1958 | Coberly | 166/53 |
| 3,283,570 | 11/1966 | Hodges . | |
| 3,378,069 | 4/1968 | Fields | 166/53 X |
| 4,424,859 | 1/1984 | Sims et al. | 166/67 |
| 4,465,139 | 8/1984 | Marquez et al. | 166/373 |
| 4,494,608 | 1/1985 | Williams et al. | 166/317 |
| 4,940,094 | 7/1990 | Lessi et al. | 166/373 |
| 4,942,926 | 7/1990 | Lessi | 166/250 X |
| 4,945,995 | 8/1990 | Tholance et al. | 166/375 |
| 5,018,574 | 5/1991 | Smith | 166/65.1 X |
| 5,042,297 | 8/1991 | Lessi | 166/250 X |
| 5,271,467 | 12/1993 | Lynch | 166/53 X |

FOREIGN PATENT DOCUMENTS

| | | |
|---|---|---|
| 0326492 | 8/1989 | European Pat. Off. . |
| 2659748 | 9/1991 | France . |

*Primary Examiner*—Roger J. Schoeppel
*Attorney, Agent, or Firm*—Young & Thompson

[57] ABSTRACT

A well completion system comprises production tubing (5) extending downhole from wellhead equipment (2) to a plurality of completion systems (7, 8, 9). A well testing facility comprising a test loop (26) with flow metering equipement (27) is included in the wellhead equipment. Each of a plurality of independently adjustable flow control means (57) is operable to stop the flow of fluid from a respective one of the completion assemblies into the production tubing. The downhole completion assemblies (7, 8, 9) are mounted on a common fluid and electrical supply means (4) comprising tubular electrical conductor means (42) and tubing (41, 45, 46) defining fluid paths.

4 Claims, 3 Drawing Sheets

WELL COMPLETION SYSTEM

The invention relates to a well completion system and is concerned with the provision of such a system incorporating features providing enhanced production from the well.

The invention accordingly provides a well completion system comprising at least one downhole completion assembly for receiving fluid from a reservoir, selectively adjustable flow control means in the completion assembly, and a fluid flow booster downstream of the completion assembly, whereby the fluid extraction rate can be optimised.

The system can include a plurality of completion assemblies in series, each incorporating a respective flow control means, typically a choke device, for individual adjustment of fluid inflow from respective reservoirs associated with the completion assemblies or from a single reservoir at spaced intervals at which the assemblies are located. The extracted fluid can comprise liquid or gas or a mixture of the two, and a submersible pump or a compressor is selected as the flow or production booster accordingly.

The production booster functions to expose the reservoir or reservoirs to a higher drawdown pressure differential than is available from the natural reservoir drive, thereby providing artificial lift. A single production booster can be operated in conjunction with a plurality of completion assemblies which can be individually tuned to a drawdown appropriate to the respective associated reservoirs or reservoir intervals, the adjustments being within a pressure range corresponding to the differential provided by the booster.

The invention thus also provides a completion assembly for a well completion system comprising tubing for receiving well effluent and for guiding the received well effluent through a variable choke device, together with control means for varying the choke device flow aperture. The choke device is preferably operable to close off the effluent flow completely.

Such a completion assembly can be employed in various forms of well completion system and the control means can be operated in response to sensed local conditions or in the context of overall system management in a system incorporating plural completion assemblies.

The invention also provides a well completion system comprising a plurality of completion assemblies each having a selectively variable choke device, wellhead equipment including a well testing facility, and control means for operating the choke devices so as to permit testing at the wellhead of individual wells, or of individual production intervals of a single well.

The wellhead equipment can thus include a test loop with metering facilities. Where the system comprises plural wells tied back to common flowlines, individual wells can be tested without interruption to production from other wells. The system can but need not include a production booster downstream of the completion assemblies, so as to provide for optimised production as described above.

The invention also provides a well completion system comprising a plurality of downhole equipment units on a common core or spine constituted by electrical and/or fluid supply means. The supply means can be constructed as power tubing extending centrally along the production tubing of the system.

The power tubing preferably includes plural conductors for the transmission of electric power and also control signals downhole from the wellhead. The conductors also transmit test and monitoring signals from the downhole equipment up to data acquisition and treatment equipment at the wellhead. Multiplexing can be employed. The power tubing also preferably incorporates fluid passage means extending between the wellhead and the downhole equipment. Plural conduits can be provided for conveying or circulating for example barrier fluid for providing overpressure protection, hydraulic fluid for operation of downhole equipment, as by way of local power units, and for the supply of chemical additives or inhibitors to be injected into the production fluid. Each unit of the downhole equipment accordingly has its respective electrical and/or fluid connections to the power tubing.

The invention also provides a well completion system comprising monitoring means at the wellhead, plural well completion assemblies, and variable flow control device responsive to signals from the monitoring unit at each completion assembly, sensor means at each completion assembly supplying signals to the monitoring means to permit continuous interactive control of production.

Such tuning of the system requires information about the performance of, and the conditions at, the (or each) completion assembly. The invention therefore also provides a well completion system including instrumentation associated with downhole equipment, means communicating the instrumentation with control equipment located at the wellhead, to permit monitoring and control of the system.

The sensor means can include sensors for logging reservoir and production flow parameters such as temperature, pressure, composition, and flow rates. Where the downhole equipment includes spaced completion assemblies receiving fluid from respective reservoirs or from respective locations in a single reservoir, the sensors can be arranged to log parameters of the respective fluid flows at the respective assemblies as well as of the combined or commingled flow downstream of the assemblies and/or at the wellhead. Where a booster pump or compressor is provided downstream of the (or each) completion assembly, this also can incorporate appropriate sensors at least for metering the flow and its characteristics. Data provided by the downhole sensor means is conveyed, conveniently, by way of the power tubing described above, if employed, to the monitoring unit at which the data is received, stored and treated to provide information for automatic or manual control functions to be exercised from the wellhead on the various units of the downhole equipment. To optimise performance of the system in dependence on sensed variations in reservoir characteristics. The downhole equipment can be controlled as a whole or selectively in respect of its various units.

Where fluid is being extracted from a plurality of reservoirs, the conditions of each can be sensed independently, by way of the instrumentation included in the associated completion assembly. By continuous or selective monitoring of the well characteristics and the performance of the downhole equipment, optimum control can be achieved by remote control without disturbing the functioning of the system and without the need to perform intervention operations.

A well completion system according to the invention can include for example heaters spaced along it to maintain temperature control of the well effluent for example to prevent deposition and solidification of particles, which might restrict the production flow. The or each completion assembly can include a heater for aiding production of heavy oils, and means for injection of chemicals and additives to function as inhibitors to prevent scaling or dehydration can be provided, for example, at the or each completion assembly. One or more downhole steam generators can be included for cyclic stimulation and subsequent extraction for example of heavy oils.

A well completion system incorporating the invention will be understood to be very advantageously employed in subsea wells and horizontal wells as well as subterrain wells, particularly in complex reservoir situations and in reservoirs with thin pay zones.

The invention is further described below, by way of example, with reference to the accompanying drawings, in which:

FIG. 1 schematically illustrates a well completion system in accordance with the invention;

Figure 1:
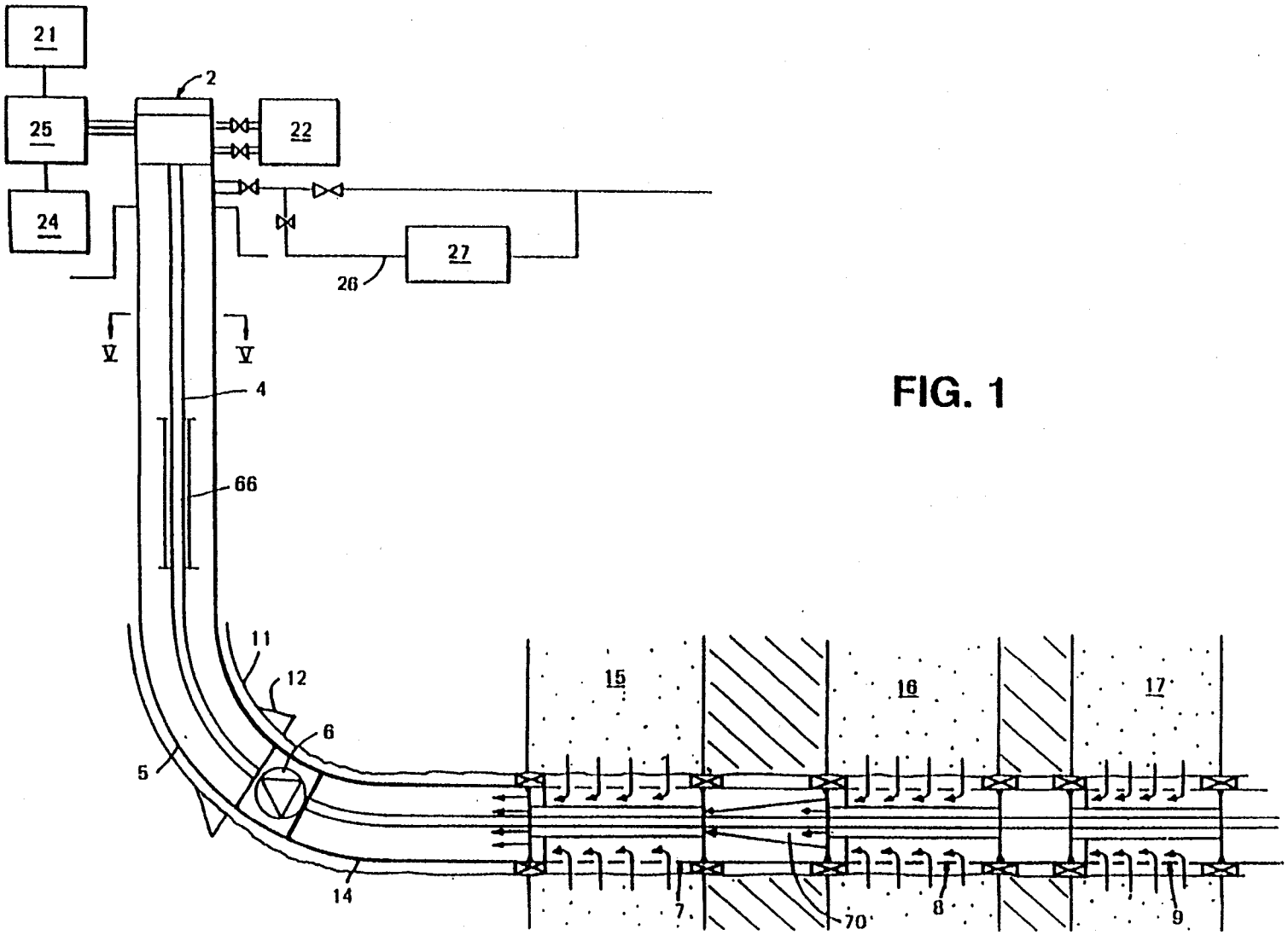

The illustrated well completion system comprises, as shown in FIG. 1, wellhead equipment 2 including a completion and production tree from which power tubing 4 extends downwardly within production tubing 5 to a production booster 6 and then to downhole completion equipment constituted here by three completion assemblies 7,8,9 spaced along the power tubing and connected in series to it. The system is shown in operative condition within a well bore containing a production casing 11 extending down from the wellhead to a production casing shoe 12.

The production tubing 5 extends down to the booster 6 which is located just below the production casing shoe 12. Beyond the booster, a production liner 14 extends through three reservoirs 15,16 & 17.

The wellhead production tree is designed to accommodate all system requirements. Thus besides structural integrity, the production tree provides for the supply of electric power from a source 21, and fluids, such as hydraulic and barrier fluids and chemical additives, from sources 22, along the power tubing 4. The tree is also arranged to facilitate retrieval and workover. Also included in the wellhead equipment 2 is an electronic data handling and control unit 24 at which is collected data from sensors located downhole and from which are transmitted command signals for controlling operation of the downhole equipment. The data and command signals are multiplexed for transmission along power conductors of the power tubing and are taken from and supplied to these conductors at 25.

The equipment 2 also provides a production test loop 26 with metering equipment 27 which can be employed to test separate remote wells tied back to common flowlines by way of subsea manifold installations. Each well may be tested individually without interrupting the production from other wells. Because of the nature of the downhole equipment, each reservoir or reservoir interval may be tested individually without intervention operations.

Figure 5:
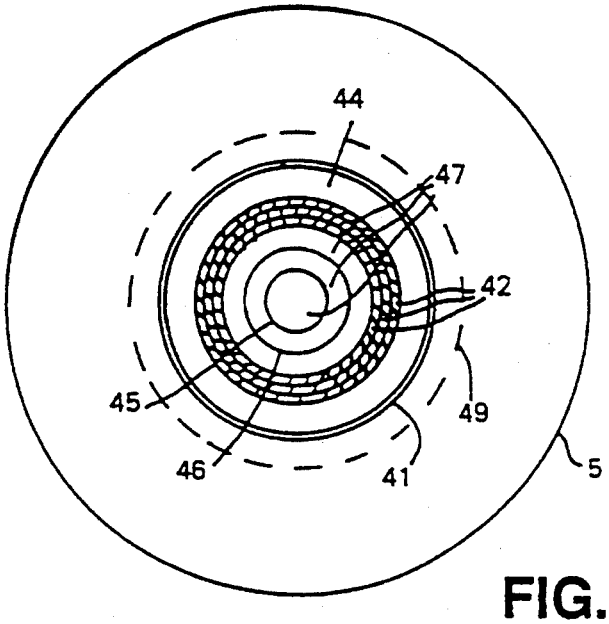
FIG. 5 is a cross-sectional view on line V—V of FIG. 1.

The power tubing 4 is preferably of concentric configuration and as shown in FIG. 5 can comprise outer protective tubing 41 having received within it with spacing to provide a first fluid conduit 44 a tubular conductor assembly. The conductor assembly consists of three concentric tubular electrical conductors 42, electrically insulated by intervening sleeves of dielectric material. Inner and outer concentric spaced tubes 45 & 46 are received within the conductor assembly to provide three further fluid conduits 47.

The power tubing can comprise sections of appropriate length, typically 9–15 meters, connected together by appropriate joint means 49 indicated schematically in FIG. 5. The power tubing equipment is run into the well bore by conventional techniques during installation, and provides for continuous distribution of electrical and fluid supplies through the entire system, as well as for conveyance of test, measurement and control signals between the wellhead control unit 24 and the various units downhole.

Referring now to the three downhole completion assemblies 7, 8 & 9, these are employed because the drainhole section of the well bore penetrates the three separate reservoirs 15, 16 & 17, but plural assemblies could be employed where a long drainhole section in a single reservoir is divided into individual production locations. Each of the completion assemblies 7, 8 & 9 controls the well inflow from the associated reservoir which it supplies into a mixed or commingled flow which is moved into the production tubing 5 by way of the booster 6.

Figure 2:
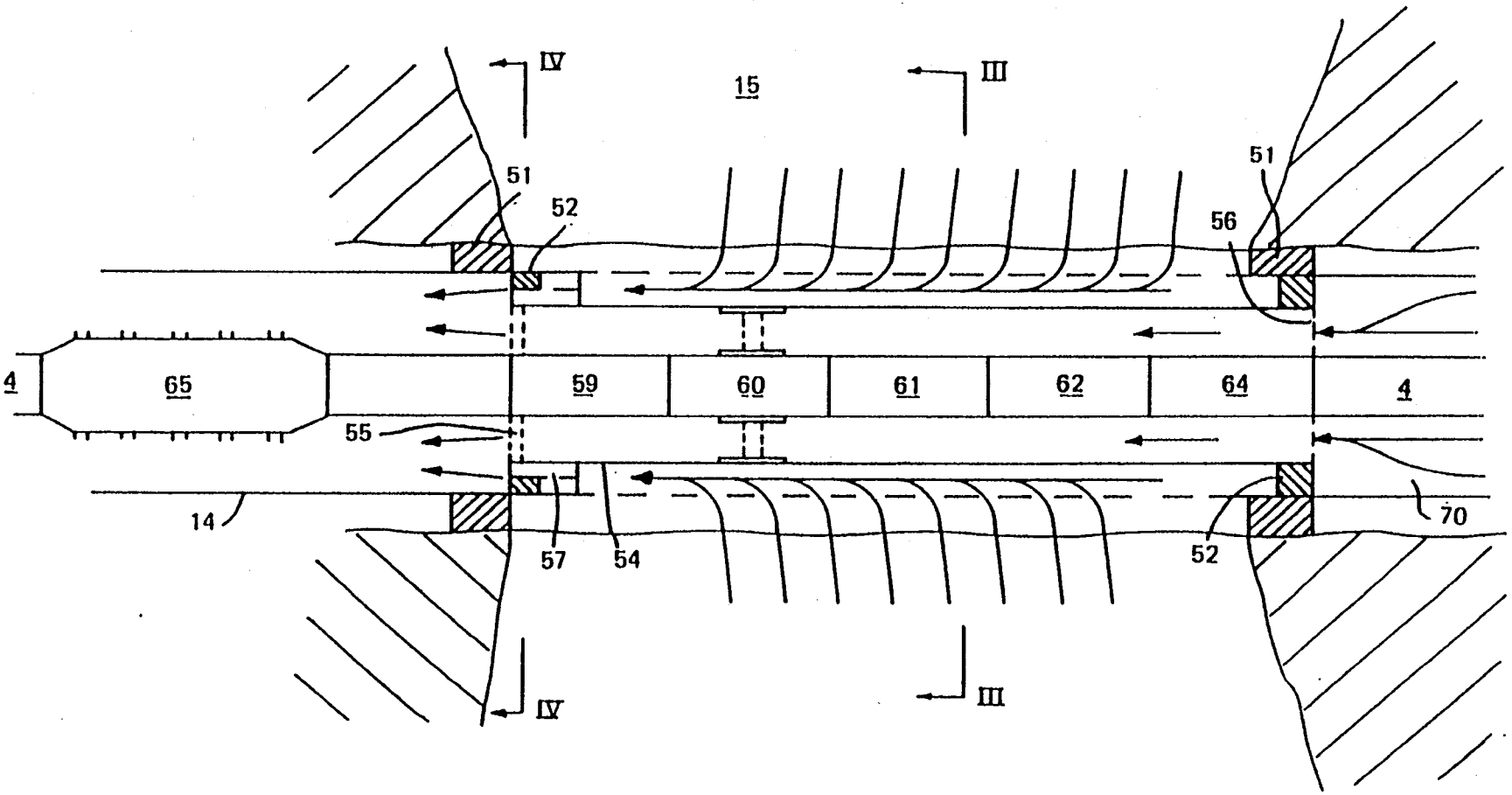
FIG. 2 is a schematic sectional side view on a larger scale of a downhole completion assembly included in the system of FIG. 1.
Figure 3:
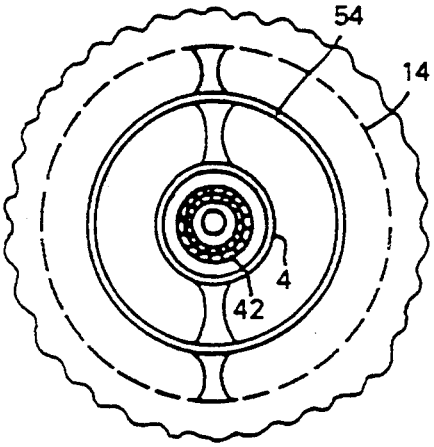
FIGS. 3 & 4 are cross-sectional views on lines III—III and IV—IV of FIG. 2 respectively.
Figure 4:
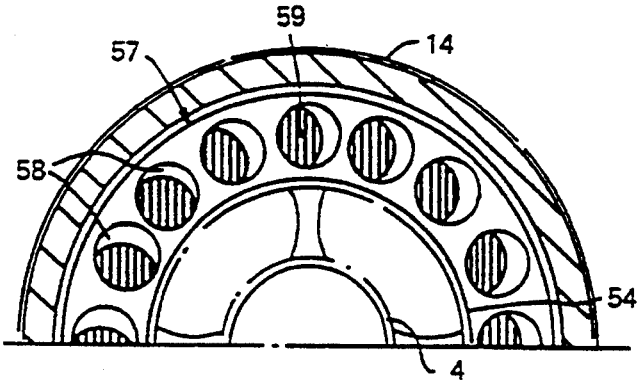

FIGS. 2–4 show the uppermost completion assembly 7 of FIG. 1 received within the production liner 14 which has perforations or slots along it over the length of the assembly to permit fluid communication between the assembly and the reservoir. The production liner 14 is sealed to the bore by packers 51 (or conventionally by cementing) which serve to separate the slotted or perforated liner sections communicating with one reservoir from those communicating with another.

The completion assembly 7 has been set in position, after installation, by inflatable completion seals 52 which serve to isolate the inflow from the downstream reservoirs 16 & 17. The assembly comprises tubing 54 concentrically surrounding the power tubing 4 to provide therewith an annular conduit for the mixed or commingled flow from the upstream assemblies through apertured upper and lower annular end walls 55,56. At the downstream end of the assembly, between the tubing 54 and the upper seal 52, a production choke 57 is provided to control the production flow from the adjacent reservoir. The flow through the choke 57 mixes with the flow through the end wall 55 in the space between the production liner 14 and the power tubing 4 and moves upwardly to the downhole production booster 6.

The production choke 57 provides a fixed annular series of flow apertures 58, the effective area of which can be selectively adjusted by rotation of a similarly apertured annulus between a fully open position, in which the fixed apertures coincide with those of the annulus, and a fully closed position, as shown in FIG. 4, in which the fixed apertures coincide with the solid portions of the annulus between its apertures. The production choke 57 is thus adjustable to control the quantity of the well effluent flowing into the commingled flow upstream of the assembly 7. The choke 57 can be employed to tune the completion assembly production and is drawn down to provide optimum reservoir extraction characteristics and to control the pressure of the common production flow.

The choke 57 is controlled from the wellhead equipment by signals from the control unit 24 carried by the power tubing 4 and is actuated by a local hydraulic power pack 59 supplied by the hydraulic supplies within the power tubing.

Besides the power pack 59, the assembly 7 includes instrumentation 60 with sensors for logging and monitoring operation of the assembly. The sensor outputs are supplied to the wellhead control unit 24 by means of the power tubing 4 through a data acquisition and transmission unit 61. Means 62 for injection into the production flow of an inhibitor or other chemical additive from the source 22 can be provided, as can a heater 64 for local production stimulation.

A downhole steam generator 65, which can be operated to enhance production particularly of heavy oils, is provided downstream of the completion assemblies, and one or more production flow heaters 66 (FIG. 1) can be located at spaced positions between the booster 6 and the wellhead to maintain optimum production temperatures and prevent waxing, scaling etc. The additional downhole equipment described is controlled and powered from the wellhead by way of the power tubing 4.

Each of the completion assemblies 8 & 9 is similar in function and configuration to the assembly 7 and neither is therefore further described. Between adjacent assemblies, an annular chamber 70 between the production liner 14 and the power tubing 4 serves as a mixing chamber for the flow from the adjacent assembly and the assembly or assemblies upstream. As for the production booster 6, a downhole submersible pump may be employed where the production fluid is a liquid or primarily a liquid, but the booster can be constituted by a compressor where the completion system is applied to a gas producing reservoir or reservoirs.

The booster 6 serves as a common booster for all three of the completion assemblies 7, 8 & 9. It adds an additional drawn down capacity to the natural flow conditions which is selected in accordance with the calculations based on tests of the reservoir inflow performance. The production booster 6 and chokes 57 of the completion assemblies thus are operated to tune the extraction process and provide optimum production rates of the commingled production flow through the production tubing.

The invention can of course be embodied in a variety of ways other than as specifically described and illustrated.

I claim:

1. A well completion system comprising:

a plurality of downhole completion assemblies, supply means carrying a fluid and an electrical supply, said supply means comprising three concentric tubular electrical conductors, dielectric sleeves between said tubular conductors, and tubing concentric with said tubular conductors defining at least one fluid supply path, and means mounting said completion assemblies in communication with said supply means.

2. The well completion system of claim 1 wherein each of said downhole completion assemblies comprises a fluid flow control means for controlling flow of fluid through said assembly and operator means for selective adjustment of said flow control means.

3. A well completion system comprising:

wellhead equipment, at least one downhole completion assembly, production tubing extending between said wellhead equipment and said at least one completion assembly, power tubing extending within said production tubing between said wellhead equipment and said at least one completion assembly, said power tubing comprising at least one tubular electrical conductor, and at least one of a logging and a monitoring means carried by said power tubing in operative association with said wellhead equipment by way of said tubular electrical conductor.

4. The well completion system of claim 3 further comprising a selectively adjustable flow control device for controlling flow of production fluid into said production tubing to any selected one of a variety of substantial flow rates, and a control unit for controlling said control device, said control unit being carried by said power tubing.

* * * * *